US005879212A

United States Patent [19]

Kennedy

[11] Patent Number: 5,879,212

[45] Date of Patent: Mar. 9, 1999

[54] SWIM FIN

[76] Inventor: Truman H. Kennedy, 132 Surf Scooter Dr., Daytona Beach, Fla. 32119

[21] Appl. No.: 113,944

[22] Filed: Jul. 10, 1998

[51] Int. Cl.[6] ..... A63B 31/11

[52] U.S. Cl. ..... 441/64; D21/236

[58] Field of Search ..... 441/61–64; D21/236–239

[56] References Cited

U.S. PATENT DOCUMENTS

| | | | |
|---|---|---|---|
| 2,903,719 | 9/1959 | Wozencraft | 441/64 |
| 3,178,738 | 4/1965 | Trell | 441/64 |
| 3,268,927 | 8/1966 | Markowitz | 441/63 |
| 3,521,312 | 7/1970 | Ganev | 441/64 |
| 4,752,259 | 6/1988 | Tackett et al. | 441/64 |
| 4,981,454 | 1/1991 | Klein | 441/62 |
| 5,041,039 | 8/1991 | Chang | 441/64 |
| 5,292,272 | 3/1994 | Grim | 441/62 |
| 5,421,758 | 6/1995 | Watson et al. | 441/61 |
| 5,447,457 | 9/1995 | Kamitani | 441/64 |
| 5,527,196 | 6/1996 | Harkin | 441/64 |
| 5,527,197 | 6/1996 | Evans | 441/64 |

FOREIGN PATENT DOCUMENTS

| | | | |
|---|---|---|---|
| 2543004 | 9/1984 | France | 441/64 |

*Primary Examiner*—Jesus D. Sotelo

*Attorney, Agent, or Firm*—Allen, Dyer, Doppelt, Milbrath & Gilchrist, P.A.

[57] ABSTRACT

A swim fin includes a blade having a web for providing a propulsion thrust in a water environment and an opposing plate having a shoe rotatably attached. The shoe is rotatable about an axis of rotation perpendicular to the blade for a rotation of the shoe from a swimming position, wherein the web extends radially outward from the toe, to a walking position, wherein the web extends radially outward from the heel. The toe of the shoe interlocks within a transverse extending flange of the web while in the swimming position. The toe includes a tongue extending radially outward for engaging the flange in a tongue in groove interlocking manner when in the swimming position. Further, a tab extends from the toe and into a notch for indexing the shoe in the swimming position. A shaft extends outward from the sole of the shoe and through the blade where it is secured to a washer for securing the shoe to the blade. The bottom side of the blade includes a recess for receiving the washer therein and providing a smooth bottom surface of the swim fin.

35 Claims, 7 Drawing Sheets

SWIM FIN

BACKGROUND OF THE INVENTION

1. Field of the Invention

The present invention relates to a swim fin typically worn by SCUBA divers, and more particularly to a swim fin which is adaptable for swimming and walking.

2. Background Art

Swim fins are well known for providing a greater propulsive force than simple kicking bare feet during swimming. It is also well known in the art that swim fins are terribly inefficient while entering and leaving the water from the beach or a boat. Typically, the swimmer will assemble and wear the appropriate diving gear, while donning the swim fins last and only when near or in the water. Further, the fins will be removed first when approaching the shore or prior to climbing a ladder to a boat. There is a need to provide a swim fin that can effectively and efficiently accommodate the swimmer when entering and leaving the water environment.

Various devices have been developed to overcome this inconvenient. By way of example, U.S. Pat. No. 2,903,719 discloses a swim fin including a fin portion that is strapped to a shoe for swimming while having the swim portion unstrapped for walking or climbing up a ladder. U.S. Pat. No. 5,292,272 to Grim discloses a swim fin for use in a swimming and walking. The swim fin includes a foot and a web mounted to the foot for movement from an extended position to an upright position. For changing from the swimming mode to the walking mode and back, the swimmer would reach down to the swim fin and pull against a spring urging force to relocate pins securing the web in its selected position. Yet further, U.S. Pat. No. 3,068,499 to Von Biskupsky discloses a swim fin that includes a web rotatable from a forward extending position to a rearwardly extending position while pivoting the web under the shoe after manually unlatching the web from its locked position.

Such reversible styled swim fins are awkward to use, especially when wearing full diving gear while going from swimming to walking or climbing a ladder.

SUMMARY OF THE INVENTION

In view of the foregoing background, it is therefore an object of the present invention to provide a swim fin that is effective for swimming and walking. It is further an object to provide such a swim fin that can be easily adjustable for movement between a swimming and walking position while permitting hands to be free for performing other tasks.

These and other objects, advantages and features of the present invention are provided by a swim fin which is efficient and practical in the water and which allows a wearer of a pair of swim fins to convert from a swimming position to a walking position for convenience in walking on the sea bottom, the beach, on ladders, boat decks, and the like.

These and other objects are realized with the swim fin of the present invention which comprises an elongate blade having a web for providing a propulsion thrust in a water environment and an opposing plate adapted for receiving a shoe, and a shoe rotatably carried by the blade. The shoe includes a toe and an opposing heel and is rotatable about an axis of rotation generally perpendicular to the blade for a rotation of the shoe from a swimming position, wherein the web extends radially outward from the toe to a walking position wherein the web extends radially outward from the heel.

The swim fin further comprises shoe interlocking means for interlocking the shoe with the web. The interlocking means in a preferred embodiment comprise a flange extending transversely across the web for receiving the toe therein. The flange includes an arcuate shape in one preferred embodiment, and the toe comprises a tongue extending radially outward therefrom, wherein the flange forms a groove with a surface of the blade and extends transversely across the blade for engaging the toe in a tongue in groove interlocking manner when in the swimming position. A tab extends outwardly from the toe into a notch within the flange for indexing the shoe to the swimming position.

The swim fin of one preferred embodiment further comprises connecting means for rotatably connecting the shoe to the blade. In one embodiment, the connecting means comprises a shaft extending outward from the sole of the shoe and through the plate along the axis of rotation, the shaft having a flange end for securing a washer thereto, and a washer carried by the shaft, the washer positioned for receiving the plate between the flange of the shaft and the sole of the shoe. The plate includes a recessed for receiving the washer therein.

A method aspect of the present invention includes using the swim fin having an elongate blade with a web for providing a propulsion thrust in a water environment and a shoe rotatably carried by the blade for rotation about an axis generally perpendicular to the blade, the shoe having a toe and a foot receiving pocket. The method includes the steps of placing each foot of a swimmer into the foot receiving pocket, rotating the shoe about the axis of rotation until the toe of the shoe is directed radially outward from the axis of rotation and away from the web for placing the swim fin in a walking position, walking to a water environment, rotating the shoe about the axis of rotation until the toe of the shoe is directed toward the web for placing the swim fin in a swimming position, and swimming in the water environment. In a preferred method, where the swim fin comprises shoe interlocking means for interlocking the shoe with the web, the method further comprises the step of interlocking the shoe with the web.

BRIEF DESCRIPTION OF DRAWINGS

The preferred embodiment of the invention as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. Further, it should be understood that words will be used for convenience to the reader and should not be construed as limiting terms.

Figure 1:
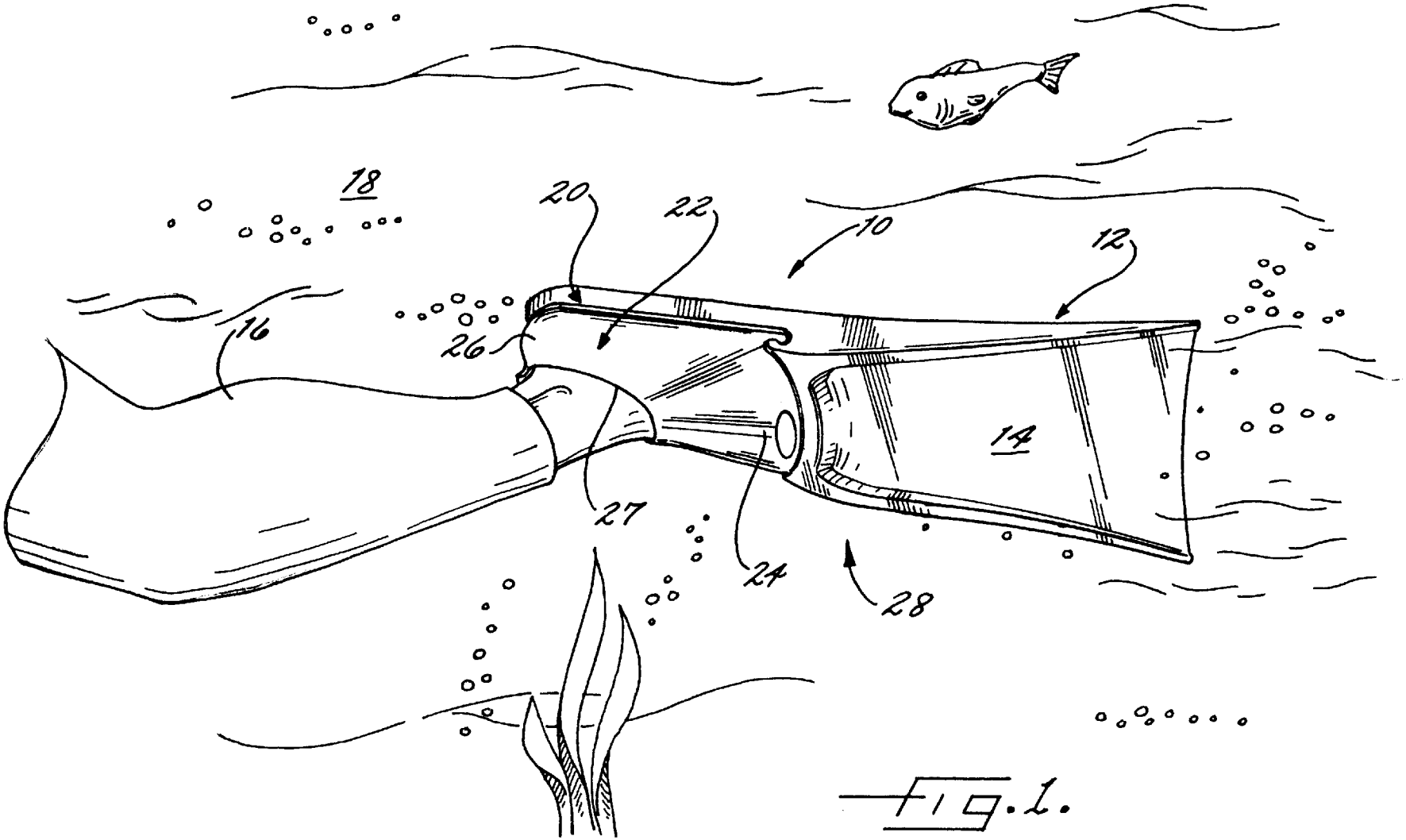
FIG. 1 is a perspective view of one preferred embodiment of the present invention operative within a swimming environment.
Figure 2A:
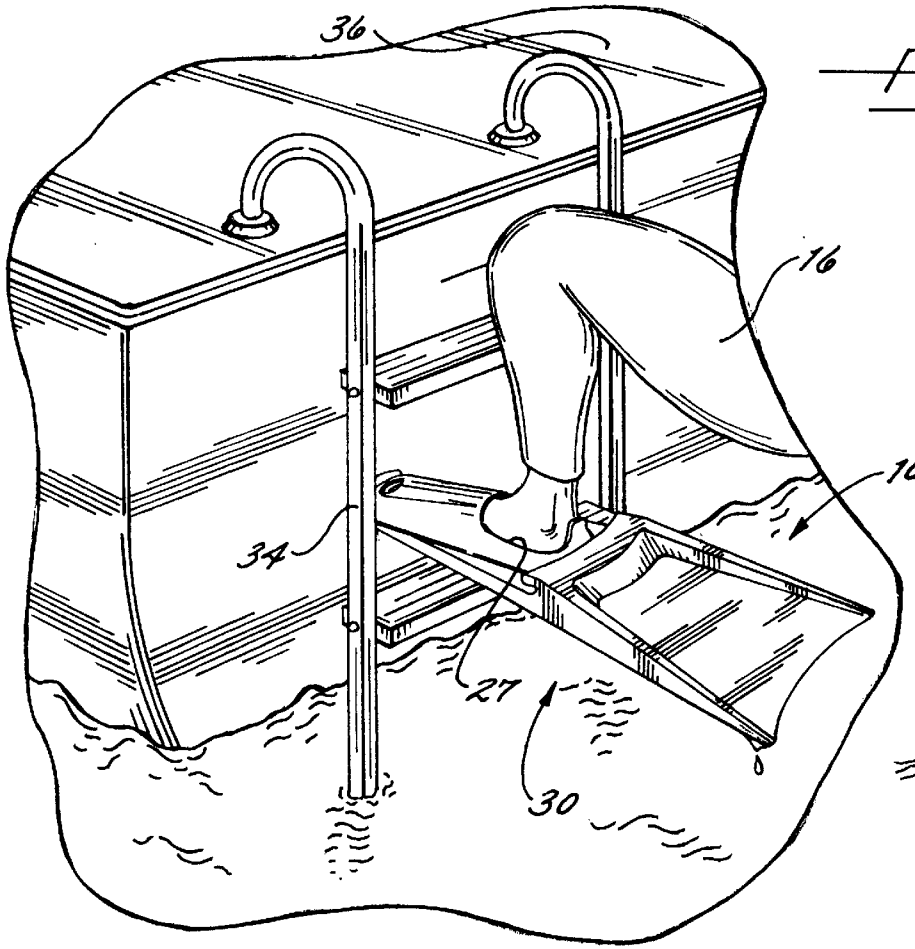
FIGS. 2A and 2B are perspective views of the preferred embodiment of FIG. 1, operative in alternative walking environments.
Figure 2B:
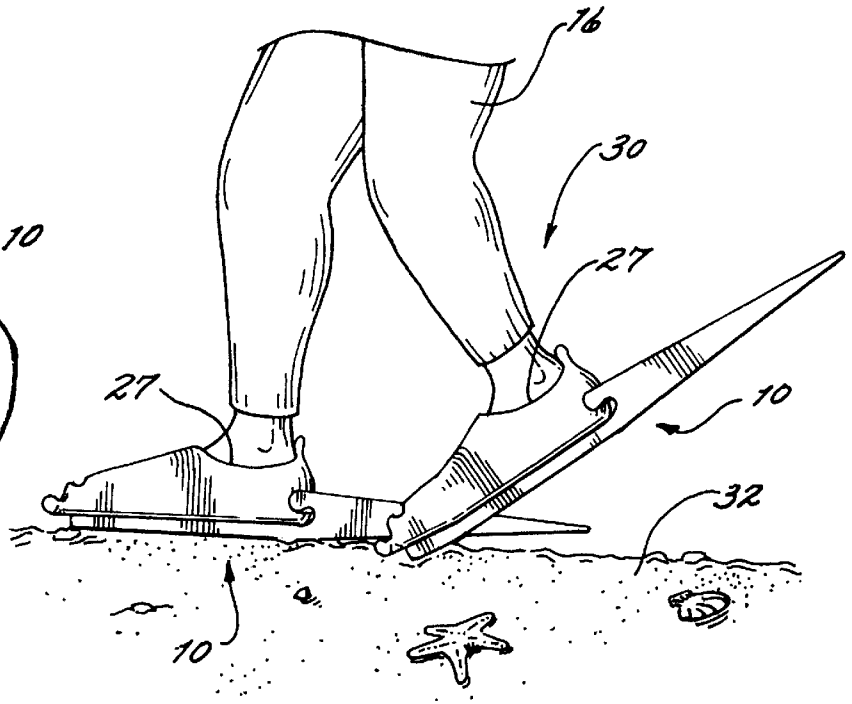

Referring now to the drawings and in particular to FIG. 1, a preferred embodiment of a swim fin 10 of the present invention comprises an elongate blade 12 having a web 14 for providing a propulsion thrust for a wearer/swimmer 16 in a water environment 18. The blade 12 has an opposing plate 20 adapted for receiving a shoe 22. The shoe 22 includes a toe 24, an opposing heel 26, and a foot receiving pocket 27. The shoe 22 is rotatably carried by the blade 12 and is rotatable from a swimming position 28, wherein the web 14 extends radially outward from the toe 24, as illustrated again with reference to FIG.1, to a walking position 30, wherein the web 14 extends radially outward from the heel 26, as illustrated with reference to FIGS. 2A and 2B.

The swim fin 10 thus permits efficient and practical use in the water environment 18, illustrated by way of example in FIG. 1, while allowing the wearer 16 of a pair the swim fin 10 to walk on the sea bottom or beach 32, on a ladder 34, or a boat deck 36. It is known in the art of swim fins to provide varying shapes for the web, including a mirror image for the left and right fins, as well as varying buckles and straps. However, with regard to the present invention, the swim fin 10 will include similar features for both the left and right foot. As a result, while it is understood that two swim fins are typically used as illustrated again with reference to FIG. 2B, only one will be described in detail, the second of the pair understood to be similar with regard to invention.

Figure 3:
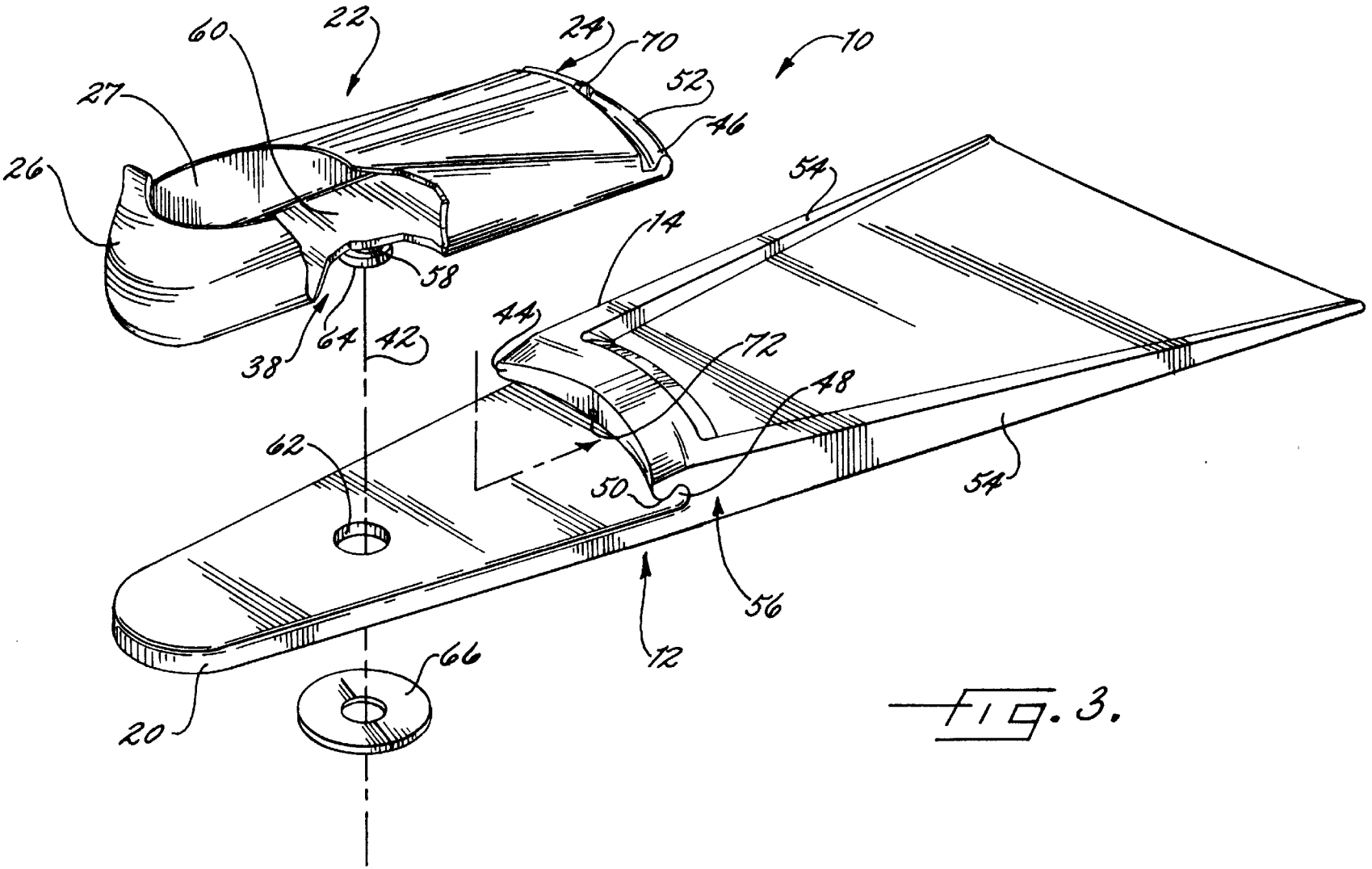
FIG. 3 is an exploded perspective and partial cut-away view of the embodiment of FIG. 1.
Figure 4:
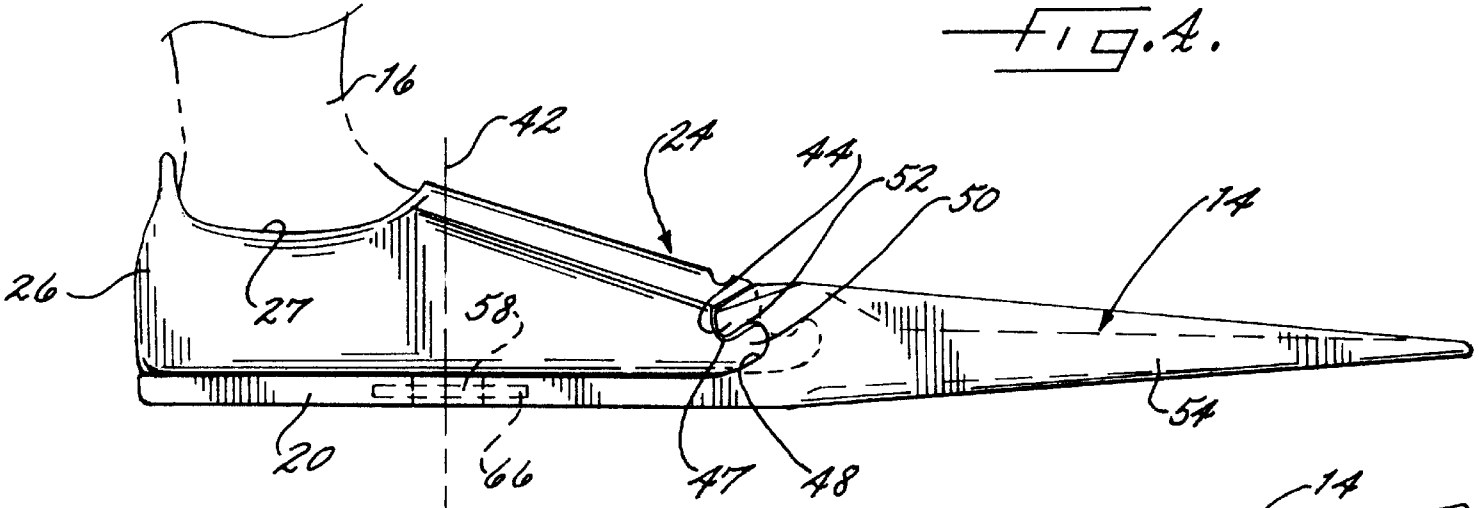
FIG. 4 is a side elevation view of the embodiment of FIG. 1 illustrating a swimming position.
Figure 5:
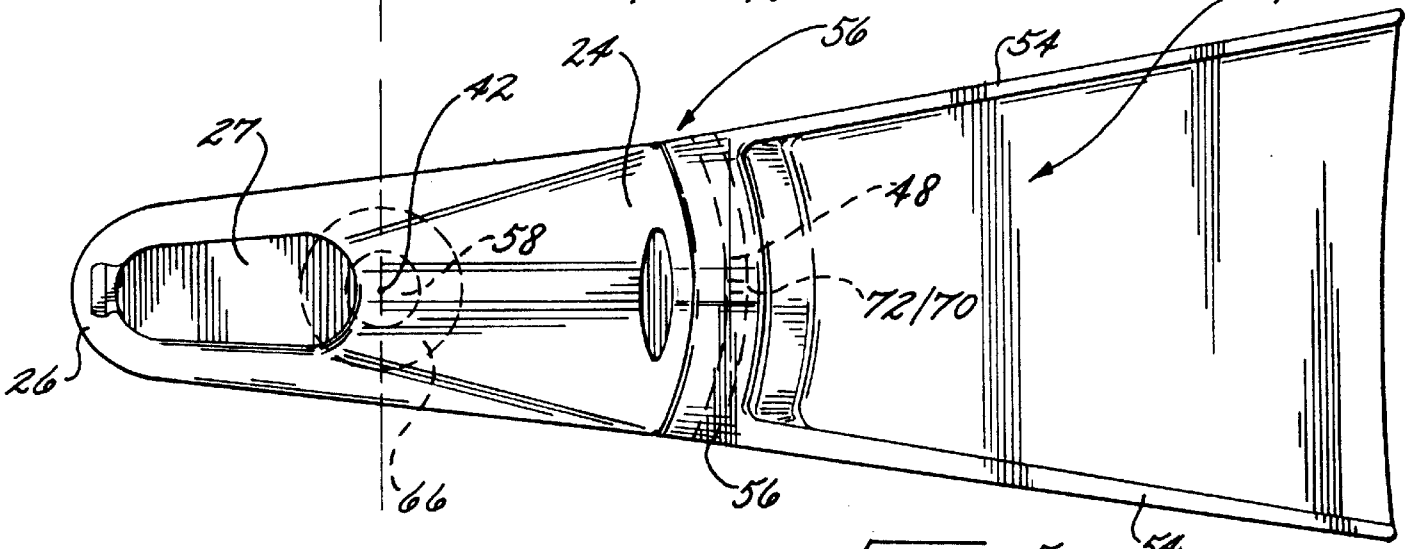
FIG. 5 is a top plan view of the embodiment of FIG. 3.
Figure 6:
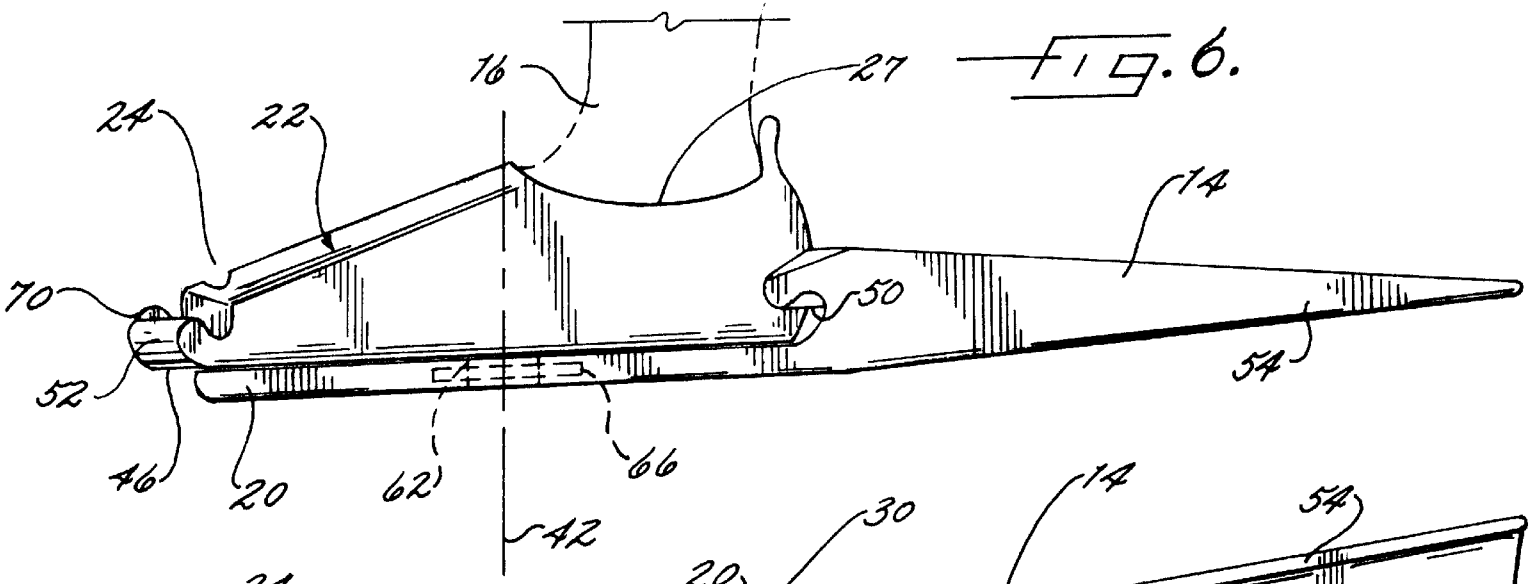
FIG. 6 is a side elevation view of the embodiment of FIG. 1 illustrating a walking position.
Figure 7:
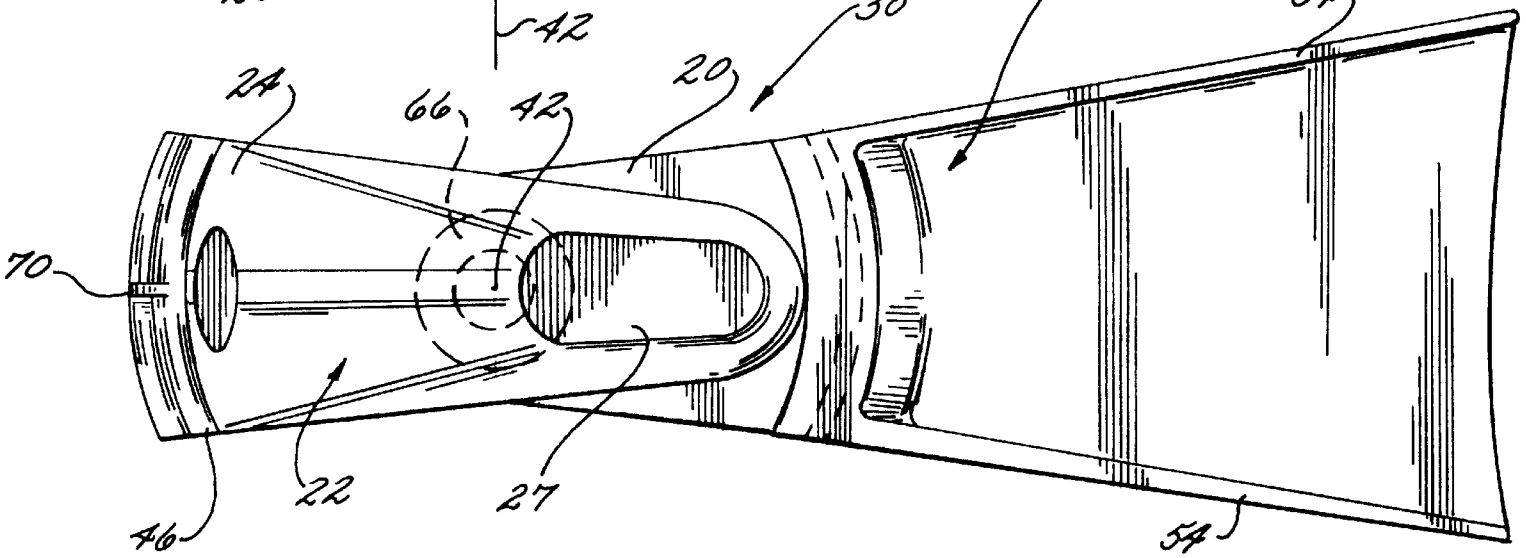
FIG. 7 is a plan view of the embodiment of FIG. 5.

As illustrated now with reference to FIG. 3, an exploded and cut away view of the rotatably connecting the shoe 22 to the blade 12. In addition, interlocking means 40 is operable in the swimming position for interlocking the toe 24 of the shoe 22 with the web 14. The shoe 22 thus rotates about an axis of rotation 42 generally perpendicular to the blade 12 for a rotation of the shoe between the swimming position 28 and the walking position 30, as earlier described with reference to FIGS.1, 2A and 2B.

In the embodiment herein described and as further illustrated with reference to FIGS. 4–9, the interlocking means 40 comprise a flange 44 extending transversely across the web 14 for receiving the toe and tongue 46 within a groove 48. As illustrated, by way of example with reference again to FIGS. 3 and 4, the flange 44 extends from the web 14 rearwardly and over the plate 20 for forming the groove 48. The tongue 46 extends radially outward from the axis of rotation 42 into the groove 48 for engaging with the flange 44 in an interlocking manner preventing the web 14 from moving away from the shoe 22 during flexing movement of the blade created when swimming and thus provide the desired thrust without having the blade disengage from the toe. As illustrated with reference again to FIGS. 4–7, a preferred embodiment includes the flange 44 extending transversely across the blade 12 in an arcuate shape for engaging the toe 24 in a tongue-in-groove styled interlocking manner when in the swimming position 28 while permitting the heel 26 of the shoe 22, or the wearer's heel in the case of an open backed shoe, to freely rotate therepast. In a preferred embodiment, the flange 44 includes an inner surface contour 50 which complements an outer contour 52 of the tongue 46 and the tongue is closely received within the groove 48 leaving a small gap 47 therebetween.

It is expected that, like those swim fins in the art, the present invention will be formed from a molded rubber, plastic material, or other suitable composition. In addition, material enhanced portions such as ribs 54 will be employed to provide stiffening where desired. Such material enhancing methods are also employed around that web aft portion 56 which includes the flange 44, thus providing the invention without a complicated or radical departure from known swim fin manufacturing techniques.

Figures 8, 9, 10:
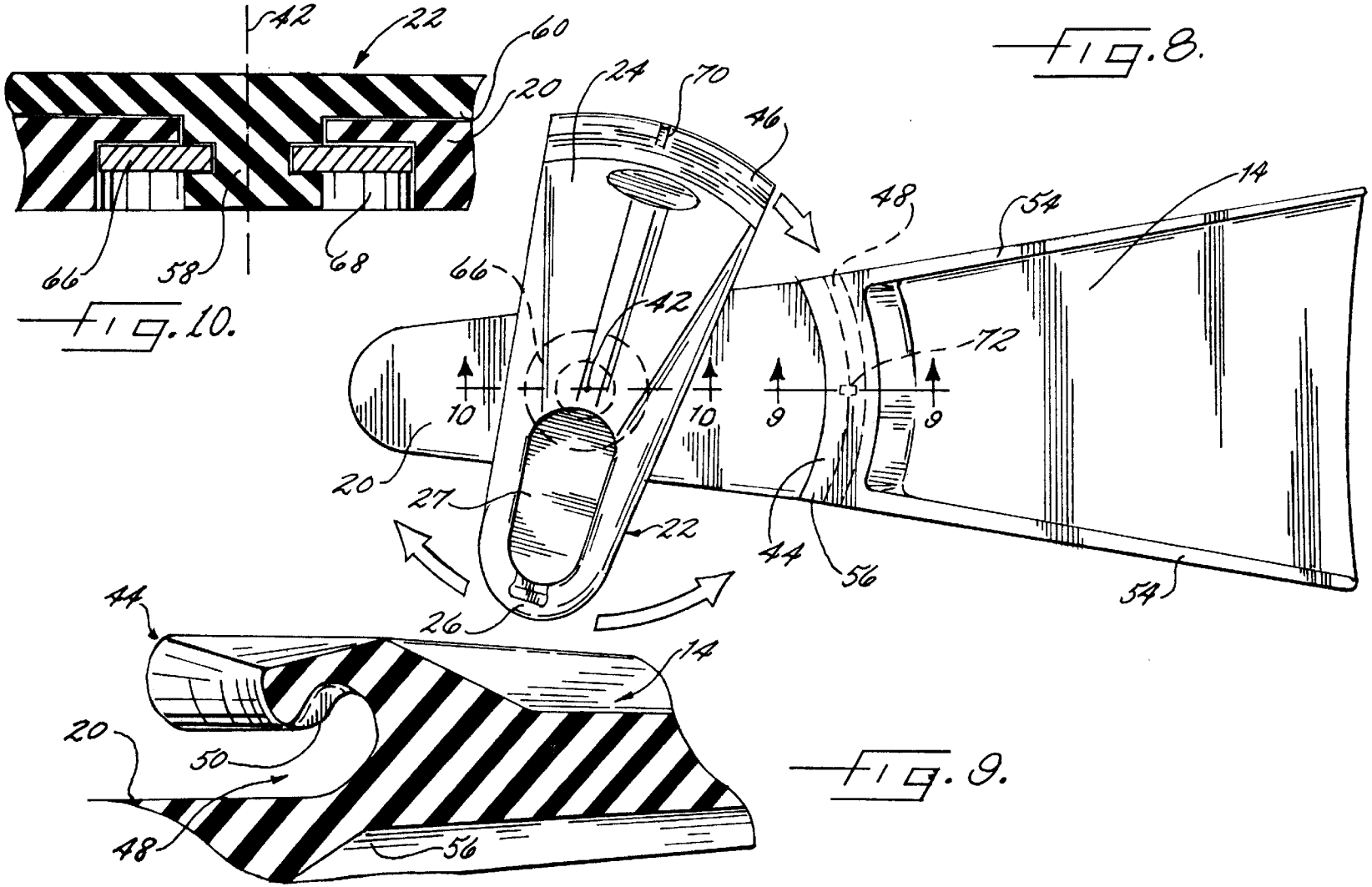
FIG. 8 is a plan view of the embodiment of FIG. 1, illustrating an intermediate position between the swimming and walking positions.
FIG. 9 is a partial cross-section view through lines 9—9 of FIG. 8.
FIG. 10 is a partial cross-section view through lines 10—10 of FIG. 8.

As illustrated with reference again to FIG. 3 and to FIG. 10, the connecting means 38 of the embodiment herein described, comprises a shaft 58 integrally formed with and extending outward from the sole 60 of the shoe 22. The shaft 58 passes through an aperture 62 within the plate 20 and extends along the axis of rotation 42. The shaft 58 includes a flanged end 64 integrally formed therewith for securing the shoe to the plate. In a preferred embodiment, a washer 66 is also carried by the shaft 58 and is positioned for receiving the plate 20 between the flanged end 64 of the shaft and the sole 60 of the shoe 22. The plate 20 further includes a recess or cavity 68 for receiving the flanged end 64 and washer 66 therein.

Figure 11:
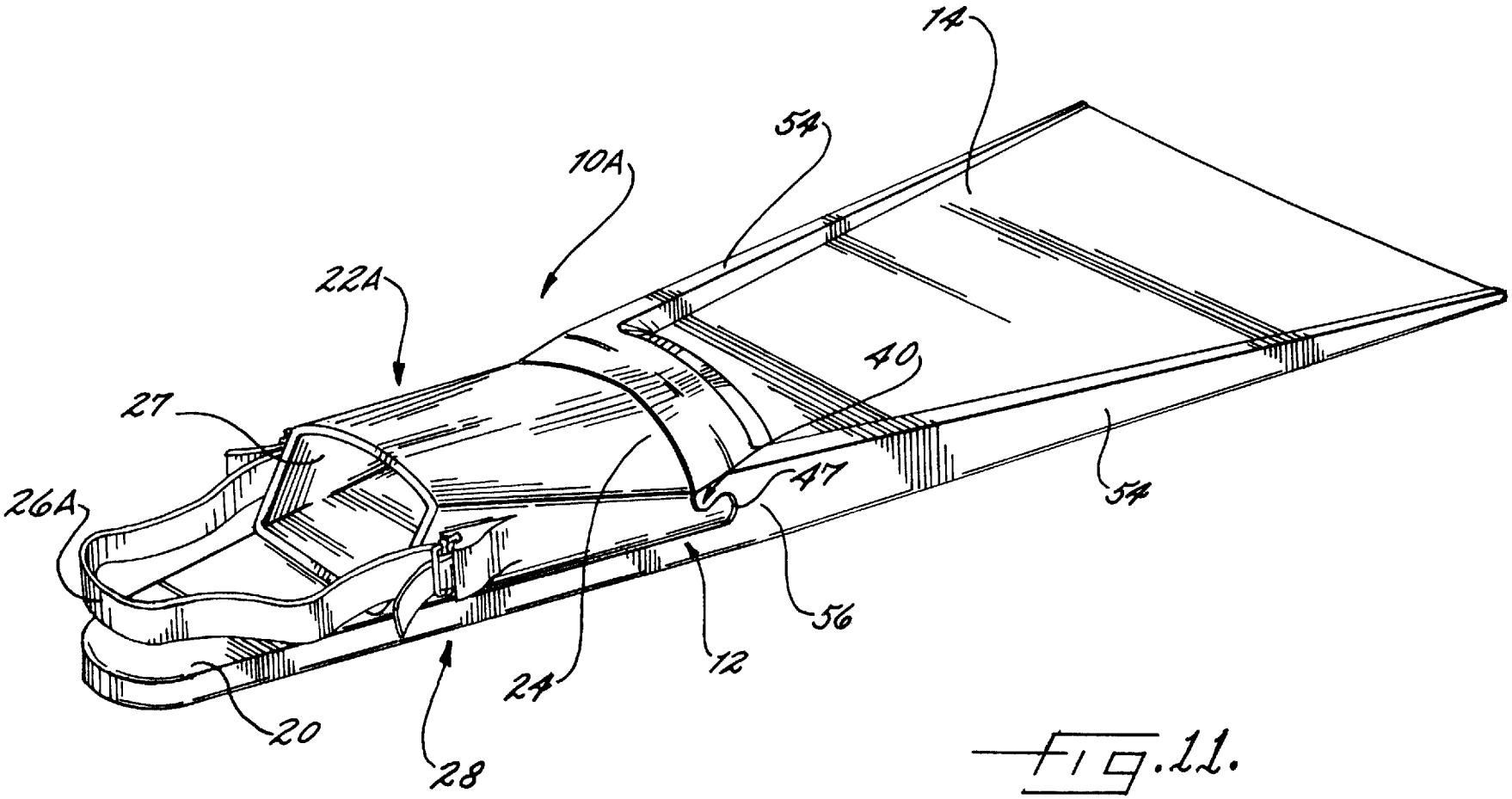
FIG. 11 is a perspective view of an alternate embodiment of FIG. 1.

As illustrated with reference again to FIG. 8, the swim fin 10 further comprises a tab 70 extending outwardly from the toe 24 and more specifically from a center of the tongue 46. Further, the flange inner surface 50 includes a notch 72 for receiving the tab 70 therein for indexing the shoe 22 in the swimming position 28. The tab 70 extends into the gap 47 when the tongue 46 is rotating through the groove 48. When the longitudinal axis of the shoe 22 is aligned with the longitudinal axis of the blade 12, as illustrated by way of example with reference again to FIG. 5, the tab 70 is received into the notch 72. And although the longitudinal axes of the shoe and blade need not be perfectly aligned, the use of the tab and notch serves as a convenient sensor for such an alignment. The swimmer can simply spin his leg for rotating the shoe out of the groove and from the swimming position to the walking position. Such will be the case for the swim fin 10 including a closed heel styled shoe 22, described above, or the open back styled shoe 22A illustrated for the swim fin 10A of FIG. 11 where a strap 26A is typically employed.

Thus being able to don the swim fin 10, rotate the shoe 22 about the axis of rotation 42 until the toe 24 of the shoe is directed radially outward from the axis of rotation and away from the web 14, walk to the water environment 18, simply rotate the shoe about the axis of rotation until the toe of the shoe is interlocked with the web, and be ready for swimming is highly desirable and satisfies a need known to all skilled in the art of using swim fins.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and other embodiments are intended to be included within the scope of the appended claims.

That which is claimed is:

1. A swim fin comprising:

an elongate blade having a web for providing a propulsion thrust in a water environment and an opposing plate adapted for receiving a shoe;

a shoe rotatably carried by the blade, the shoe having a toe and an opposing heel, the shoe rotatable about an axis of rotation generally perpendicular to the blade for a rotation of the shoe from a swimming position, wherein the web extends radially outward from the toe to a walking position wherein the web extends radially outward from the heel; and interlocking means including a toe-receiving flange for interlocking the shoe to the web.

2. The swim fin according to claim 1, wherein the flange includes an arcuate shape and extends transversely across the web.

3. The swim fin according to claim 1, wherein the toe comprises a tongue extending radially outward therefrom, and wherein the flange forms a groove with the blade and extends transversely across the blade for engaging the toe in a tongue-in-groove interlocking manner when in the swimming position.

4. The swim fin according to claim 1, further comprising a tab extending outwardly from the toe, and wherein the flange includes a notch for receiving the tab therein and for indexing the shoe in the swimming position.

5. The swim fin according to claim 1, further comprising connecting means for rotatably connecting the shoe to the blade.

6. The swim fin according to claim 5, wherein the plate includes an aperture extending therethrough, and the connecting means comprises a shaft extending outward along the axis of rotation from the sole of the shoe and through the aperture of the plate, the shaft having a flanged end for securing the plate thereto.

7. The swim fin according to claim 6, further comprising a washer carried by the shaft, the washer positioned for receiving the plate between the washer and the sole of the shoe.

8. The swim fin according to claim 6, wherein the plate includes a recess for receiving the washer therein.

9. A swim fin comprising:

an elongate blade having a web with a forward portion for providing a propulsion thrust in a water environment, an opposing plate adapted for receiving a shoe, and an intermediate area between the forward portion and the plate;

a shoe having a toe and an opposing heel and sole therebetween;

connecting means for rotatably connecting the shoe to the blade about an axis of rotation generally perpendicular to the blade, the connecting means operable for rotation of the shoe from a swimming position, wherein the web extends radially outward from the toe, to a walking position wherein the web extends radially outward from the heel; and wherein the toe of the shoe is interlocked to the blade it the intermediate area when in the swimming position.

10. The swim fin according to claim 9, wherein the intermediate area comprises a flange extending transversely across the web for receiving the toe therein.

11. The swim fin according to claim 10, wherein the toe comprises a tongue extending radially outward therefrom, and wherein the flange forms a groove extending transversely across the blade for engaging the toe in a tongue in groove interlocking manner when in the swimming position.

12. The swim fin according to claim 10, wherein the flange includes an arcuate shape.

13. The swim fin according to claim 10, further comprising a tab extending outwardly from the toe, and wherein the flange includes a notch for receiving the tab therein and indexing the shoe in the swimming position.

14. The swim fin according to claim 9, wherein the connecting means comprises:

a shaft extending outward from the sole of the shoe and through the plate along the axis of rotation, the shaft having a flange end for securing a washer thereto; and a washer carried by the shaft, the washer positioned for receiving the plate between the flange of the shaft and the sole of the shoe.

15. The swim fin according to claim 14, wherein the plate includes a recess for receiving the washer therein.

16. A swim fin comprising:

an elongate blade having a web for providing a propulsion thrust in a water environment and an opposing plate adapted for receiving a shoe;

a shoe rotatably carried by the blade, the shoe having a toe and an opposing heel, the shoe rotatable about an axis of rotation generally perpendicular to the blade for a rotation of the shoe from a swimming position, wherein the web extends radially outward from the toe, to a walking position wherein the web extends radially outward from the heel; and interlocking means operable in the swimming position for interlocking the toe of the shoe to the web.

17. The swim fin according to claim 16, further comprising connecting means for rotatably connecting the shoe to the blade.

18. The swim fin according to claim 17, wherein the connecting means comprises:

a shaft extending outward from the sole of the shoe and through the plate along the axis of rotation, the shaft having a flange end for securing a washer thereto; and a washer carried by the shaft, the washer positioned for receiving the plate between the flange of the shaft and the sole of the shoe.

19. The swim fin according to claim 18, wherein the plate includes a recess for receiving the washer therein.

20. The swim fin according to claim 16, wherein the shoe interlocking means comprise a flange extending transversely across the web for receiving the toe therein.

21. The swim fin according to claim 20, wherein the toe comprises a tongue extending radially outward therefrom, and wherein the flange forms a groove extending transversely across the blade for engaging the toe in a tongue in groove interlocking manner when in the swimming position.

22. The swim fin according to claim 20, wherein the flange includes an arcuate shape.

23. The swim fin according to claim 16, further comprising a tab extending outwardly from the toe, and wherein the toe interlocking means include a notch for receiving the tab therein and indexing the shoe in the swimming position.

24. A method of using a swim fin having an elongate blade with a web for providing a propulsion thrust in a water environment and a shoe rotatably carried by the blade for rotation about an axis generally perpendicular to the blade, the shoe having a toe and a foot receiving pocket, and interlocking means including a toe-receiving flange for interlocking the shoe to the web, the method comprising the steps of:

placing each foot of a swimmer into the foot receiving pocket;

rotating the shoe about the axis of rotation until the toe of the shoe is directed radially outward from the axis of rotation and away from the web for placing the swim fin in a walking position;

walking to a water environment;

rotating the shoe about the axis of rotation until the toe of the shoe is directed toward the web and into an interlocking position with the toe held in the toe-receiving flange for placing the swim fin in a swimming position; and swimming in the water environment.

25. The method according to claim 24, wherein the toe-receiving flange includes an arcuate shape and extends transversely across the web.

26. The method according to claim 24, wherein the toe comprises a tongue extending radially outward therefrom, and wherein the flange forms a groove with the blade and extends transversely across the blade, the method comprising the step of engaging the toe in a tongue-in-groove interlocking manner for the swimming step.

27. The method according to claim 24, further comprising a tab extending outwardly from the toe, and wherein the toe-receiving flange includes a notch, the method further comprising the step of rotating the shoe until the tab is received within the notch, thus indexing the shoe to the swimming position.

28. The method according to claim 24, wherein a shaft extends outwardly along the axis of rotation from the sole of the shoe and through an aperture in the blade, the shaft having a flanged end for securing the shoe to the blade.

29. A method of using a swim fin having an elongate blade with a web for providing a propulsion thrust in a water environment and a shoe rotatably carried by the blade for rotation about an axis generally perpendicular to the blade, the shoe having a toe and a foot receiving pocket, the web having interlocking means for interlocking the toe of the shoe to the web, the method comprising the steps of:

placing each foot of a swimmer into the foot receiving pocket;

rotating the shoe about the axis of rotation until the toe of the shoe is directed radially outward from the axis of rotation and away from the web for placing the swim fin in a walking position;

walking to a water environment;

interlocking the toe of the shoe to the web by rotating the shoe about the axis of rotation until the toe of the shoe is directed toward the web for placing the swim fin in a swimming position; and swimming in the water environment.

30. The method according to claim 29, wherein the interlocking means comprise a flange for receiving the toe therein, the interlocking step comprising the step of engaging the toe of shoe within the flange.

31. The method according to claim 30, wherein the flange includes an arcuate shape and extends transversely across the web.

32. The method according to claim 30, wherein the toe comprises a tongue extending radially outward therefrom, and wherein the flange forms a groove with the blade and extends transversely across the blade.

33. The method according to claim 32, wherein the interlocking step comprises the step of engaging the toe in a tongue-in-groove interlocking manner for the swimming step.

34. The method according to claim 30, further comprising a tab extending outwardly from the toe, and wherein the flange includes a notch, the method further comprising the step of rotating the shoe until the tab is received within the notch for indexing the shoe to the swimming position.

35. The method according to claim 29, wherein a shaft extends outwardly along the axis of rotation from the sole of the shoe and through an aperture in the blade, the shaft having a flanged end for securing the shoe to the blade.

* * * * *